United States Patent [19]

Roessler

[11] Patent Number: 4,649,572

[45] Date of Patent: Mar. 17, 1987

[54] DISPOSABLE BIB WITH AN IMPROVED POCKET FORMED WITH AN ACCORDION FOLD

[75] Inventor: Thomas H. Roessler, Menasha, Wis.

[73] Assignee: Kimberly-Clark Corporation, Neenah, Wis.

[21] Appl. No.: 868,363

[22] Filed: May 27, 1986

[51] Int. Cl.[4] ..... A41B 13/10

[52] U.S. Cl. ..... 2/49 R

[58] Field of Search ..... 2/49 R, 48, 49 A

[56] References Cited

U.S. PATENT DOCUMENTS

| | | | |
|---|---|---|---|
| 2,367,383 | 1/1945 | Tiscornia | 2/49 |
| 3,329,969 | 7/1967 | Farber et al. | 2/49 |
| 3,332,547 | 7/1967 | Rowe et al. | 206/56 |
| 3,416,157 | 12/1968 | Marder et al. | 2/49 |
| 3,654,629 | 4/1972 | Crisman et al. | 2/49 R |
| 3,995,321 | 12/1976 | Johnson | 2/49 |
| 4,416,025 | 11/1983 | Moret et al. | 2/49 |
| 4,441,212 | 4/1984 | Ahr et al. | 2/49 |
| 4,445,231 | 5/1984 | Noel | 2/49 |
| 4,495,658 | 1/1985 | Moret et al. | 2/49 |

FOREIGN PATENT DOCUMENTS

| | | | |
|---|---|---|---|
| 2015867 | 9/1979 | Sweden | 2/49 R |
| 715557 | 9/1954 | United Kingdom | 2/49 R |
| 1463863 | 2/1977 | United Kingdom . | |

*Primary Examiner*—Doris L. Troutman

*Attorney, Agent, or Firm*—Paul Yee

[57] ABSTRACT

A protective bib garment includes a base sheet member which has lengthwise extending side edges and longitudinal end portions. A catcher member connects to the base sheet member and extends transversely thereacross to form a catcher pocket. The catcher pocket has lateral side edges connected to the side edges of the base sheet member and has a fold portion connected to one longitudinal end portion of the base sheet member to provide an expandable, transversely extending multiple-V fold section therewith. A fastening mechanism holds the garment on a wearer.

9 Claims, 6 Drawing Figures

DISPOSABLE BIB WITH AN IMPROVED POCKET FORMED WITH AN ACCORDION FOLD

FIELD OF THE INVENTION

The present invention pertains to protective garments, such as disposable bibs for infants. More particularly, the present invention pertains to a protective bib garment which has a distinctive catcher pocket which more effectively catches and holds spilled materials.

BACKGROUND OF THE INVENTION

Various types of protective garments have been employed to protect the clothes of a wearer from unintentional soiling. For example, U.S. Pat. No. 3,328,807 issued July 4, 1967 to K. Strauss discloses a protective bib which includes a catcher pocket at the bottom end thereof. Other patents which show protective bibs with catcher pockets are U.S. Pat. No. 3,329,969 issued July 11, 1967 to J. Farber, et al.; U.S. Pat. No. 3,332,547 issued July 25, 1967 to C. Rowe, et al.; and U.S. Pat. No. 3,416,157 issued Dec. 17, 1968 to H. Marder, et al.

The catcher pockets employed with conventional protective bibs have not readily remained open. As a result, various bib configurations have been developed to help hold the bib pocket open. For example, U.S. Pat. No. 3,995,321 issued Dec. 7, 1976 to S. Johnson discloses a bib which includes adhesive tabs designed to attach the front lip of the pocket to the edge of a table and thereby hold the bib pocket open. Other bib designs have employed a depending apron which is connected to the front lip of the bib pocket and which is configured to gravitationally open the pocket and hold it open. For example, see U.S. Pat. No. 4,495,658 issued Jan. 29, 1965 to D. Moret, et al.; U.S. Pat. No. 4,445,231 issued May 1, 1984 to J. Noel; U.S. Pat. No. 4,441,212 issued Apr. 10, 1984 to N. Ahr, et al.; and U.S. Pat. No. 4,416,025 issued Nov. 22, 1983 to D. Moret, et al.

Bib configurations have also employed side gusset members to help hold the bib pocket open. For example, see British Pat. No. 1,463,863 published Feb. 9, 1977 with K. Andersson as the listed inventor; and U.S. Pat. No. 2,367,383 issued Jan. 16, 1945 to J. Tiscornia.

Conventional protective bib garments, such as those described above, have not been completely satisfactory. The conventional bibs have required complex manufacturing techniques and have not provided a sufficiently reliable and convenient mechanism for holding the catcher pocket open. In addition, the bib configurations which attach a part of the bib to a piece of furniture can undesirably limit the movement of the wearer and can put excessive stresses on the bib structure.

BRIEF DESCRIPTION OF THE INVENTION

The present invention provides a distinctive protective bib garment which includes a base sheet member having lengthwise extending side edges and longitudinal end portions. A catcher member connects to the base sheet member and extends transversely thereacross to form a catcher pocket. The catcher member has lateral side edges connected to the side edges of the base sheet member and has a fold portion connected to one longitudinal end portion of the base sheet member to provide an expandable, transversely extending multiple-V fold section therewith. Fastening means hold the garment on a wearer.

The protective garment of the invention provides a distinctive catcher pocket which more effectively captures and holds spilled materials. The improved pocket configuration more readily remains in the open position and can be efficiently manufactured.

BRIEF DESCRIPTION OF THE DRAWINGS

The invention will be more fully understood and further advantages will become apparent when reference is made to the following detailed description of the invention and the drawings in which.

DETAILED DESCRIPTION OF THE INVENTION

The following description of the protective garment of the invention will be made in the context of a bib, particularly a baby bib. However, it will be readily apparent that the present invention can be adapted for use and incorporated into other protective garments, such as aprons and the like. All of such uses are contemplated as being within the scope of the present invention.

Figure 1:
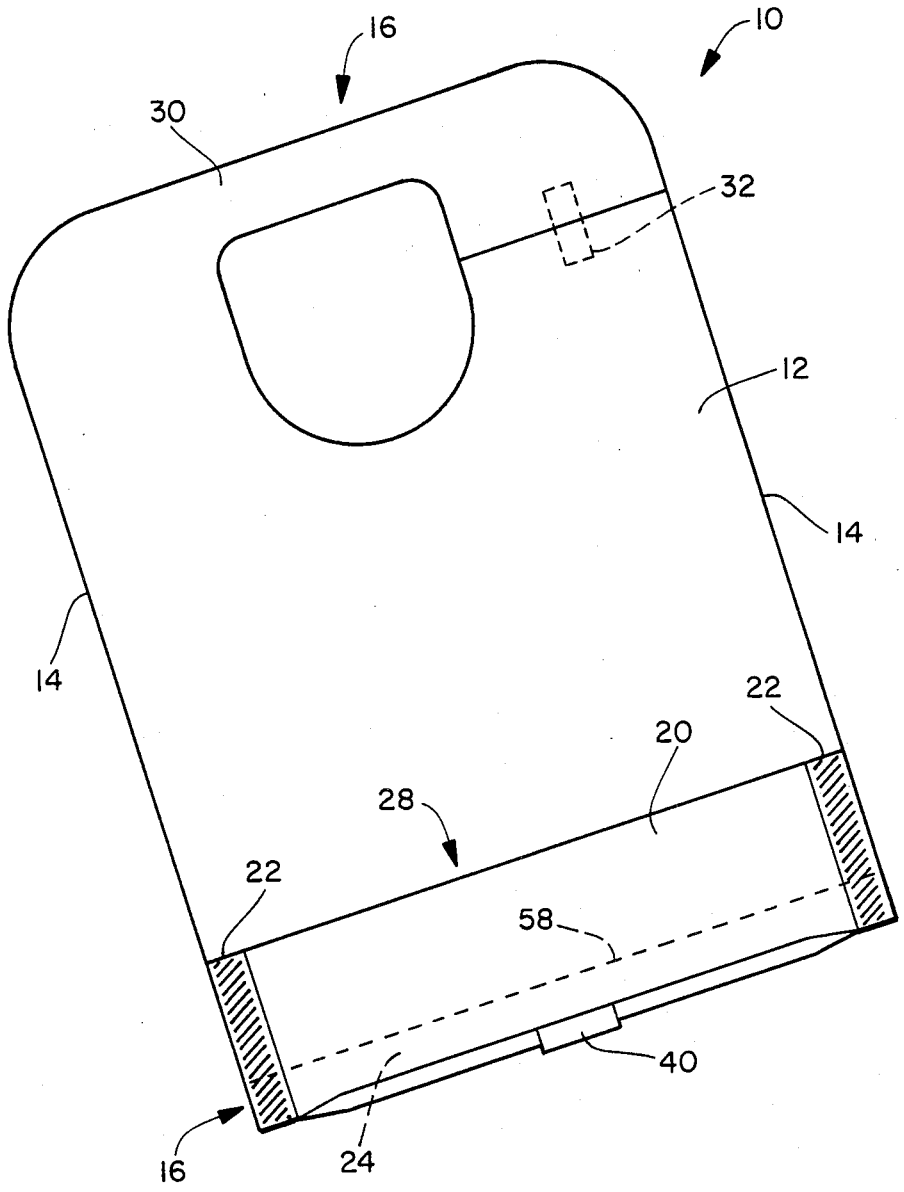
FIG. 1 shows an isometric view of a representative bib garment.

Referring now to FIG. 1, bib 10 includes a base sheet member 12 which has lengthwise extending side edges 14 and longitudinal end portions 16. A catcher member 20 connects to base sheet member 12 and extends transversely thereacross to form a catcher pocket 28. The catcher member has lateral side edges 22 which connect to the side edges 14 of base sheet member 12. Catcher member 20 also has a fold portion 24 which connects to one longitudinal end portion 16 of the base sheet member to provide an expandable, transversely extending multiple-V fold section therewith. Fastening means, such as neckband 30 and neck fastening tape 32 hold the bib on a wearer.

In a particular aspect of the invention, bib 10 further comprises attaching means, such as adhesive tape tab 40. Tape tab 40 connects to the expandable multiple-V fold section 24 to secure the fold section to the wearer and to apply a force which expands the multiple-V fold to hold open catcher pocket 28.

Base sheet 12 may be composed of any suitable woven or nonwoven web material. For example, base sheet 12 can comprise a nonwoven web of spunbonded filaments, a coform material composed of cellulose fibers mixed with meltblown polymeric fibers, a spunbonded web coated with an extruded thermoplastic film, or a bonded carded web manufactured employing conventional techniques.

Figure 5:
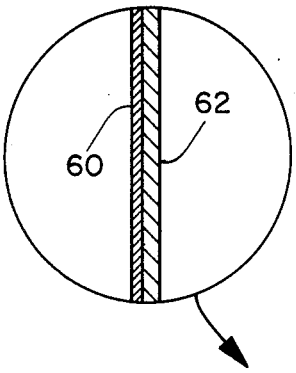
FIG. 5 representatively shows a magnified, edge view of the base sheet member of the garment of FIG. 4.

In a particular aspect of the invention illustrated in FIG. 5, base sheet 12 comprises at least two layers. The first, body side layer is composed of a substantially liquid impermeable material, such as a polyolefin film. Suitable films include, for example, polyethylene and polypropylene films. The second, outer side layer 62 is composed of an absorbent material, such as tissue wadding or airformed, cellulosic fibers. The outer side layer is attached in adjacent, facing relation with body side layer 60. With this configuration, the substantially liquid impermeable body side layer protects the clothes of the wearer from spilled or dropped materials, and the absorbent outer side layer 62 helps to retain and reduce the runoff of spilled liquids.

Figure 2:
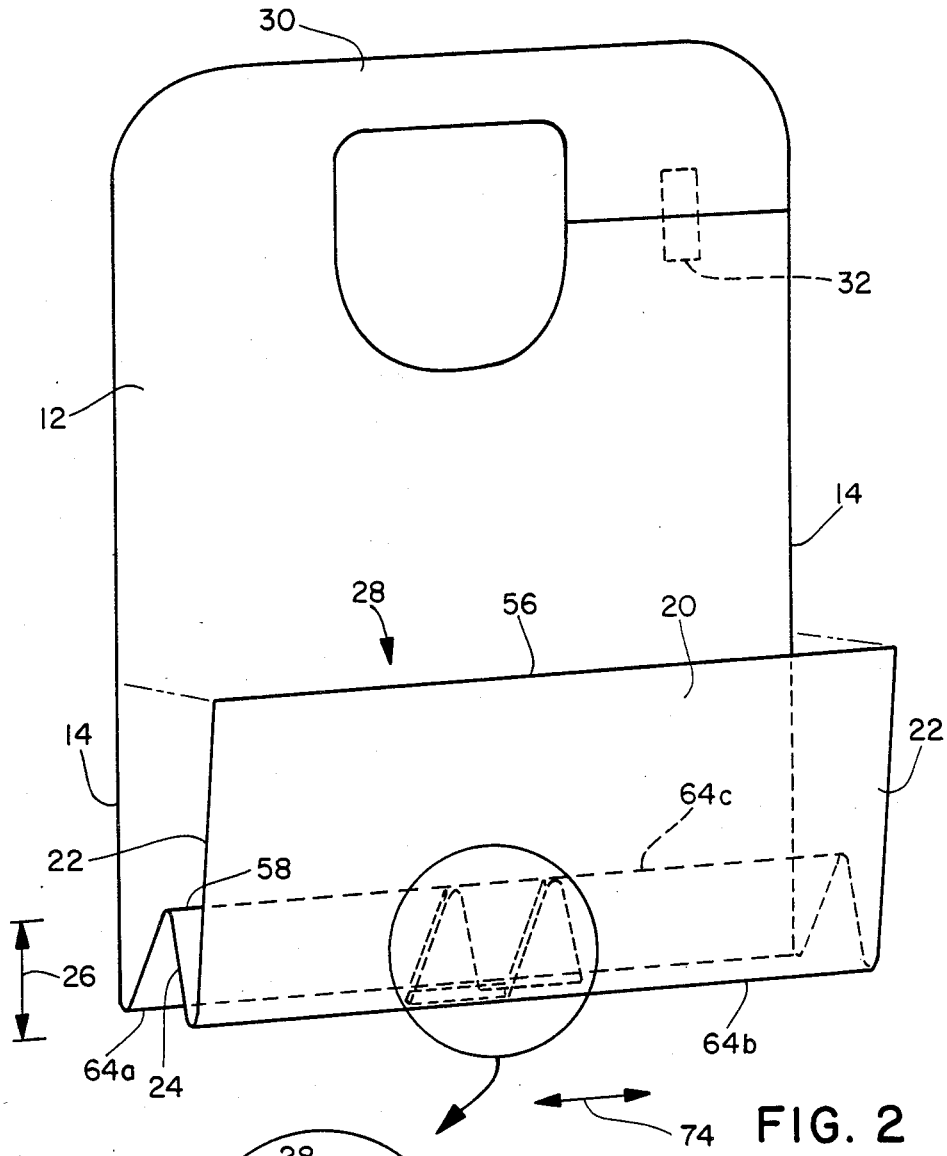
FIG. 2 representatively shows an exploded view of a multiple-V fold section which interconnects the bib pocket panel to the bib base sheet.

Catcher member 20 forms a panel which extends transversely across the outer side surface of base sheet 12. The catcher member interconnects with the bottom edge of base sheet 12 with a fold portion 24, as illustrated in FIG. 2. In the shown embodiment, catcher member 20 and base sheet 12 interconnect to form a W-fold configuration. However, in alternative embodiments of the invention, the catcher member and the base sheet member can interconnect with other types of multiple-V folds to form an accordion-type folded structure.

For the purposes of the present description, catcher member 20 and base sheet member 12 have been described as separate elements. However, it is readily apparent that a single base sheet member 12 can be folded along transverse fold lines 64*a–c* to form an integrally connected base sheet member and catcher member.

Figure 4:
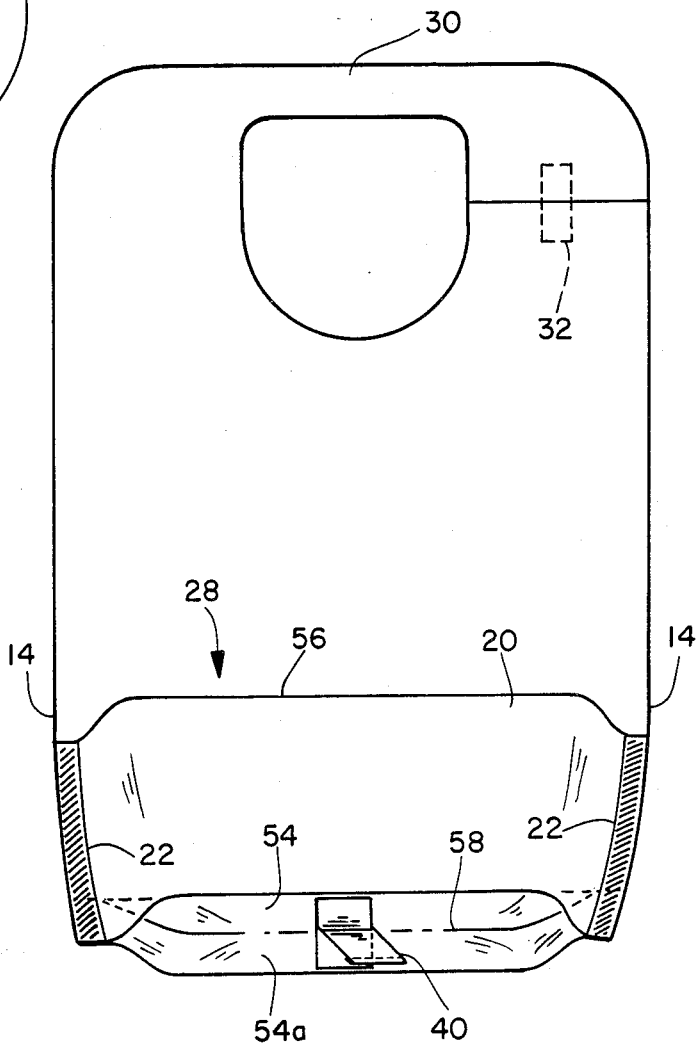
FIGS. 4 and 4A representatively show alternative catcher pocket configurations.

To form the desired pocket structure, the lateral side edges 22 of catcher member 20 and fold portion 24 are secured to each other and to the side edges 14 of base sheet 12 with suitable securing means, as representatively shown in FIG. 4. For example, side edges 14 and 22 can be secured with adhesive, thermal bonds, sonic bonds and the like. Preferably, catcher member side edges 22 are sealingly connected to base sheet 12 to completely seal and close the lateral edges of catcher pocket 28 and render the pocket capable of holding spilled liquids. The edge securing means may be configured to extend generally parallel with side edge 14, as illustrated, or may be configured to run non-parallel with the base sheet side edge. For example, the line of securement may angle inwardly, toward the longitudinal centerline of the garment, as the securement line extends from the open, lip-edge 56 of the catcher pocket to the bottom edges of the pocket. This angled configuration can be employed to produce a more bowl-shaped catcher pouch.

Figure 4A:
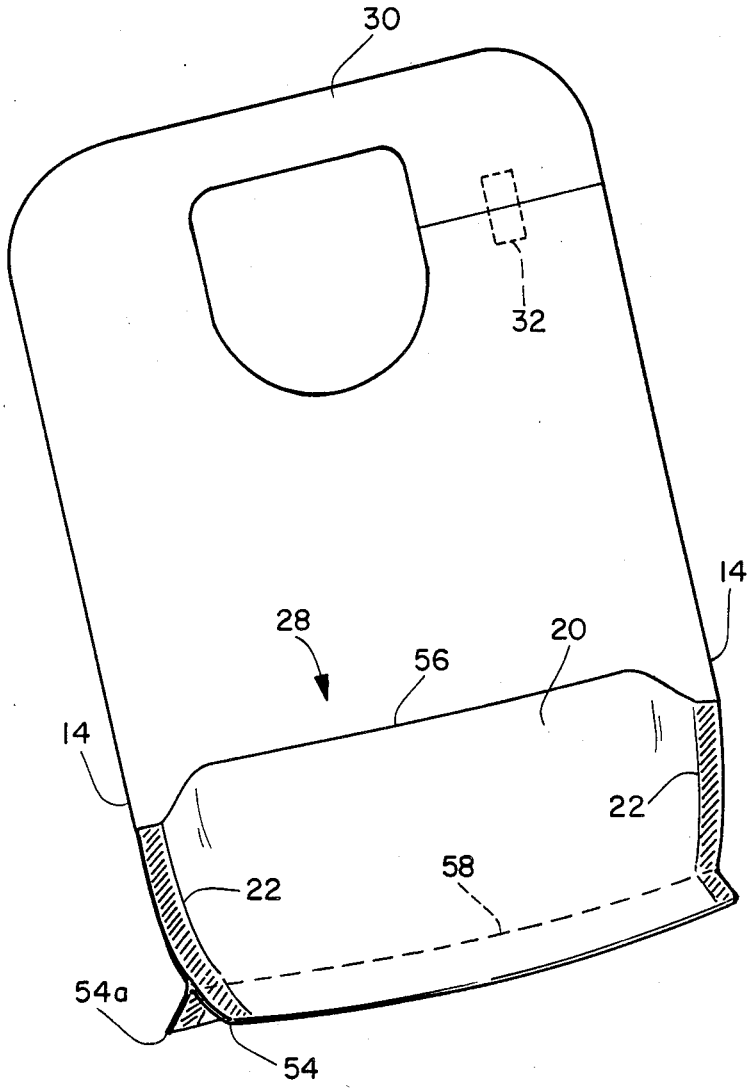

FIG. 4A representatively shows yet another, alternative configuration of the catcher pocket. In the shown arrangement, the side edges of fold panel 54 is secured to the adjacent side edges of the front panel of catcher member 20, and the side edges of fold panel 54*a* are secured to the adjacent side edges of base sheet 12. The side edges of fold panel 54, however, are not secured to the adjacent side edges of fold panel 54*a*.

The multiple-V fold configuration provides one or more peaks 58 of material which extend from the bottom of catcher pocket 28 toward the upwardly facing opening of the catcher pocket. Fold peaks 58 can have a height dimension 26 which measures up to 50% of the cross directional width of base sheet 12, and preferably have a height dimension which ranges from about 5–15% of the cross directional width of the base sheet.

During use, catcher pocket 28 is activated by forcing fold peaks 58 in an outward direction toward the bottom of the catcher pocket. This operation expands the folded portion 24 of the bib and forces catcher member 20 outwardly away from base sheet 12. As a result, the upper lip 56 of the catcher member bows or otherwise moves outwardly to open catcher pocket 28. As the catcher pocket is forced open, at least a portion of one or more of fold peaks 58 becomes inverted toward the outside of the catcher pocket and assumes a substantially "locked", semi-rigid position which is sufficiently fixed in position to hold the catcher pocket open.

The described operation and activation of catcher pocket 28 requires that the material employed to produce base sheet 12 and catcher member 20 have an operable combination of flexibility and stiffness. In particular, the material should be flexible enough to readily drape across the body of the wearer and to produce folds which can be readily expanded and closed. In addition, the material should have sufficient stiffness, particularly along fold panels 54, to operably hold the catcher pocket open when portions of fold peaks 58 have been forced into their inverted, "locked" position.

A suitable technique for determining the stiffness of the bib material is with a HANDLE-O-METER machine and TAPPI procedure T 498 hm-85. For example, when employing a Thwing Albert Model No. 211-5 HANDLE-O-METER, a suitable bib material has a stiffness value of at least about 9 gm, and preferably has a "modified" stiffness value of about 100–300 gm for improved effectiveness. This modified stiffness value is determined with TAPPI procedure T 498 hm-85, but with a test sample which measures only 2.25 in×4.5 in. The resultant stiffness value obtained per the TAPPI procedure is then multiplied by a factor of four to arrive at the modified stiffness value set forth above.

A distinctive retaining means may also be employed to help hold catcher pouch 28 in its open, activated position. In a particular aspect of the invention, a retaining means, such as a pressure-sensitive adhesive tape tab, connects to the expandable multiple-V fold section 24. The tape tab is affixed within the multiple-V fold and is capable of being adhesively fastened to the wearer. When the tape tab is secured to the wearer, a tension is imparted to the tab which applies a force that holds the fold peaks in a generally flattened position and operably expands the multiple-V fold to hold open the catcher pocket.

Figure 3:
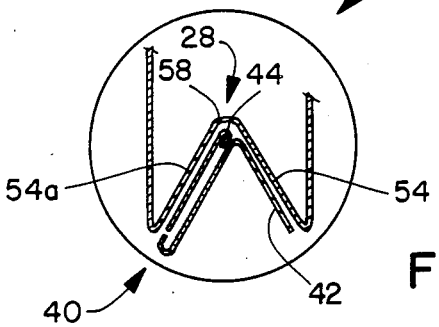
FIG. 3 representatively shows an exploded cross-sectional side view of a section of FIG. 2.

Referring now to FIG. 3, the shown embodiment of tape tab 40 comprises a pressure-sensitive adhesive tape 42 and a release tape 44. The length of tape tab 40 extends generally along the expansion direction 74 of the bib. One end of pressure-sensitive tape 42 is affixed to fold panel 54 and the other end of the pressure-sensitive tape is covered with release tape 44. The release tape, in turn, is affixed within the bib fold portion 24. In the shown embodiment, a release layer comprising tape 44 is affixed to a second fold panel 54*a*, and the attaching tape 40 is folded to conform to the contour of the underlying bib material.

It is readily apparent that multiple tape tabs or various other configurations of tape tab 40 may also be employed. To provide improved effectiveness, however, the tape tab is preferably configured and arranged to exert a desired downward tensile force directed at or near a central peak region of the multiple-V fold.

The use of tape tab 40 provides an efficient retaining means which can more reliably holds open catcher pocket 28. In particular, when tape tab 40 is separated from release tape 44 and then drawn outwardly and downwardly toward the bottom of the catcher pocket, the movement of the tape tab forces fold panel 54 to also move outwardly and downwardly to flatten fold peak 58. This movement expands the multiple-V fold and operably opens catcher pocket 28. Once tape tab 40 is adhesively secured to the wearer, the multiple-V folds are retained in their expanded condition and the catcher pocket is reliably held in its open position to catch any dropped or spilled materials.

Having thus described the invention in rather full detail, it will be readily apparent to a person having ordinary skill in the art that various changes and modifications may be made without departing from the spirit of the invention. All of such changes and modifications are contemplated as being within the scope of the invention defined by the subjoined claims.

What is claimed is:

1. A protective garment, comprising:

a. a base sheet member which has lengthwise extending side edges and longitudinal end portions;

b. a catcher member which connects to said base sheet member and extends transversely thereacross to form a catcher pocket, said catcher member having lateral side edges connected to the side edges of said base sheet member and having a fold portion connected to a longitudinal end portion of said base sheet member to provide an expandable, transversely extnding multiple-V fold section therewith;

c. retaining means connected to said expandable multiple-V fold section for applying a force at or near a peak of said multiple-V fold to hold said multiple-V fold expanded and open said catcher pocket; and d. fastening means for holding said garment on a wearer.

2. A protective garment as recited in claim 1, wherein said multiple-V fold comprises W-type fold.

3. A protective garment as recited in claim 1, wherein said multiple-V fold comprises an accordion-type fold.

4. A protective garment as recited in claim 1, wherein said base sheet member comprises:

a. a body side layer composed of a substantially liquid impermeable material; and b. an outer side layer composed of an absorbent material which is connected in adjacent, facing relation with said body side layer.

5. A protective garment as recited in claim 1, wherein said retaining means is constructed to apply a tensile force on said multiple-V fold.

6. A protective garment as recited in claim 5, wherein said retaining means is constructed to secure said garment to the wearer.

7. A protective garment as recited in claim 6, wherein said retaining means comprises an adhesive tape tab affixed within said multiple-V fold and capable of being adhesively fastened to the wearer.

8. A protective garment as recited in claim 1, wherein said base sheet member has a HANDLE-O-METER stiffness value of at least about 9 gm.

9. A protective garment as recited in claim 1, wherein said base sheet member has a HANDLE-O-METER, modified stiffness value of about 100–300 gm.

* * * * *